US006213104B1

(12) United States Patent
Ishikiriyama et al.

(10) Patent No.: US 6,213,104 B1
(45) Date of Patent: Apr. 10, 2001

(54) METHOD AND A DEVICE FOR SUPPLYING FUEL TO AN INTERNAL COMBUSTION ENGINE

(75) Inventors: Mamoru Ishikiriyama, Mishima; Sumio Kamiya, Toyota; Makoto Hiei, Shizuoka; Nobuaki Takazawa, Susono; Yasushi Takahashi, Susono; Syozi Miyazaki, Susono, all of (JP)

(73) Assignee: Toyota Jidosha Kabushiki Kaisha, Aichi (JP)

( * ) Notice: Subject to any disclaimer, the term of this patent is extended or adjusted under 35 U.S.C. 154(b) by 0 days.

(21) Appl. No.: 09/165,353

(22) Filed: Oct. 2, 1998

Related U.S. Application Data

(63) Continuation-in-part of application No. 08/799,628, filed on Feb. 12, 1997.

(30) Foreign Application Priority Data

Feb. 14, 1996 (JP) ..... 8-26903

(51) Int. Cl.[7] ..... F02G 5/00

(52) U.S. Cl. ..... 123/557; 123/27 GE

(58) Field of Search ..... 123/3, 557, 558, 123/576, 276 E, 575, 142.5 R, 25 C, 538

(56) References Cited

U.S. PATENT DOCUMENTS

| | | | | |
|---|---|---|---|---|
| 3,717,129 | | 2/1973 | Fox . | |
| 3,765,389 | | 10/1973 | Henchel | 123/142.5 R |
| 3,945,352 | * | 3/1976 | Reimuller | 123/557 |
| 4,112,889 | * | 9/1978 | Harpman | 123/25 B |
| 4,147,142 | * | 4/1979 | Little et al. | 123/133 |
| 4,189,914 | | 2/1980 | Marek et al. | 60/726 |
| 4,204,504 | * | 5/1980 | Dabrio | 123/573 |
| 4,358,930 | | 11/1982 | Pope et al. | 60/647 |
| 4,395,998 | * | 8/1983 | Chou | 123/575 |
| 4,402,296 | * | 9/1983 | Schwarz | 123/575 |
| 4,483,305 | * | 11/1984 | Gilmor | 123/557 |
| 4,483,307 | * | 11/1984 | Gilmor | 123/558 |

(List continued on next page.)

FOREIGN PATENT DOCUMENTS

| | | |
|---|---|---|
| 3428783 A1 | 2/1986 | (DE) . |
| 0 506 069 A1 | 9/1982 | (EP) . |
| 0 432 960 A1 | 4/1991 | (EP) . |
| 55-007966 | 1/1980 | (JP) . |
| 6-137218 | 5/1994 | (JP) . |
| 1242250 A1 | 7/1986 | (SU) . |

OTHER PUBLICATIONS

"Patent Abstracts of Japan", vol, 018, No. 444 (M–1658), Aug. 18, 1994 of JP 6–137218 A, May 17, 1994 (1 page).
Partial European Search report dated Apr. 29, 1997 (4 pages).
European Search Report dated Sep. 24, 1997 (4 pages).
Communication dated Oct. 1, 1997.
Kazushi Tsurutani et al., "Effects of Oxygenates and Poly–Aromatics on Exhaust Emissions from IDI Diesel Engine", pp. 229–232 (Sep. 1995).
Information List (Form 1) (1 page).
Communication dated May 18, 1997 (1 page).

*Primary Examiner*—Willis R. Wolfe
*Assistant Examiner*—Hai Huynh
(74) *Attorney, Agent, or Firm*—Finnegan, Henderson, Farabow, Garrett & Dunner, L.L.P.

(57) ABSTRACT

According to the present invention, the state of a liquid fuel such as diesel fuel is made a supercritical state by raising the pressure and the temperature of the fuel above the critical pressure and temperature. Then, the fuel is injected from the fuel injection valve into the combustion chamber of the engine in the supercritical state. When the fuel in the supercritical state is injected into the combustion chamber of the engine, it forms an extremely fine uniform mist in the entire combustion chamber. Therefore, the combustion in the engine is largely improved.

5 Claims, 9 Drawing Sheets

U.S. PATENT DOCUMENTS

| | | | | |
|---|---|---|---|---|
| 4,499,862 | * | 2/1985 | Baumer et al. | 123/1 A |
| 4,522,183 | | 6/1985 | Meier et al. | 123/557 |
| 4,629,550 | | 12/1986 | Dohler et al. . | |
| 4,640,234 | * | 2/1987 | Olsson et al. | 123/25 C |
| 4,665,881 | * | 5/1987 | Wade | 123/557 |
| 5,007,381 | | 4/1991 | Kakegawa et al. | 123/1 A |
| 5,245,953 | | 9/1993 | Shimada et al. | 123/25 C |
| 5,375,850 | | 12/1994 | Stolz et al. | 123/527 |
| 5,408,957 | | 4/1995 | Crowley . | |
| 5,535,708 | * | 7/1996 | Valentine | 123/25 C |
| 5,649,515 | * | 7/1997 | Fuchs et al. | 123/557 |

* cited by examiner

Fig.7

| TIME (MIN) \ TEMP. (°C) | 350 | 375 | 400 | 425 | 450 | 475 | 500 | 530 | 550 |
|---|---|---|---|---|---|---|---|---|---|
| 1 | C | C | C | C | C | A | A | A | A |
| 5 | C | C | C | C | C | A | A | A | A |
| 10 | C | C | C | C | B | A | A | A | A |
| 15 | C | C | C | C | B | A | A | A | A |
| 30 | C | C | C | C | A | A | A | A | A |
| 45 | C | C | C | B | A | A | A | A | A |
| 60 | C | C | B | A | A | A | A | A | A |
| 120 | C | C | B | A | A | A | A | A | A |

Fig.8

| TIME (MIN) \ TEMP. (°C) | 350 | 375 | 400 | 425 | 450 | 475 | 500 | 530 | 550 |
|---|---|---|---|---|---|---|---|---|---|
| 1 | A | A | A | A | A | A | A | A | B |
| 5 | A | A | A | A | A | A | A | A | C |
| 10 | A | A | A | A | A | A | A | B | C |
| 15 | A | A | A | A | A | A | B | C | C |
| 30 | A | A | A | A | A | A | C | C | C |
| 45 | A | A | A | A | A | A | C | C | C |
| 60 | A | A | A | A | A | B | C | C | C |
| 120 | A | A | A | A | C | C | C | C | C |

Fig.9

| | NORMAL DIESEL FUEL (JIS JTD-5) | REFORMED FUEL |
|---|---|---|
| KIMEMATIC VISCOSITY (50℃)(mm/s) | 2.49 | 1.76 |
| CETANE NUMBER | 54 | 53 |
| INITIAL BOILING POINT (℃) | 179 | 51 |
| FLASH POINT (℃) | 63 | LOWER THAN 23 |

METHOD AND A DEVICE FOR SUPPLYING FUEL TO AN INTERNAL COMBUSTION ENGINE

CROSS-REFERENCE TO RELATED APPLICATIONS

This application is a continuation-in-part of the U.S. patent application Ser. No. 08/799,628 filed on Feb. 12, 1997.

BACKGROUND OF THE INVENTION

1. Field of the Invention

The present invention relates to a method and a device for supplying fuel to an internal combustion engine. More specifically, the invention relates to a method and a device in which a liquid fuel supplied to the engine is in a supercritical state.

2. Description of the Related Art

In general, a fuel supply system for an internal combustion engine is required to supply liquid fuel to combustion chambers of the engine in the form of a very fine mist. Especially, in a direct cylinder injection system for injecting fuel into the combustion chamber directly, such as the injection system of a diesel engine, the size of particles of the injected fuel largely affects the performance of the engine. In the direct cylinder injection system, the combustion of the fuel in the combustion chamber, and thus the performance of the engine can be largely improved by reducing the size of the particles of the injected fuel.

It is thought that high pressure fuel injection, in which fuel is injected from the fuel injection valve at a very high pressure, is effective in order to reduce the size of the particles of the injected fuel. Therefore, in recent fuel injection systems, the fuel injection pressure is set at a very high value in order to satisfy the requirement for low exhaust gas emission and low fuel consumption. For example, some of the fuel injection systems for diesel engines use a fuel injection pressure as high as more than 50 MPa (500 atm) to generate very fine particles of injected fuel in the combustion chamber.

However, in the high pressure fuel injection system a fuel pump which is capable of pressurizing the fuel to a very high pressure is required. Since the high pressure fuel pump is very expensive, this increases the cost of whole fuel injection system. Further, in the high pressure fuel pump, the clearances between the sliding parts must be small in order to prevent the high pressure fuel from leaking. This tends to cause wear of the sliding parts and lowers the reliability of the pump.

SUMMARY OF THE INVENTION

In view of the problems in the related art as set forth above, the object of the present invention is to provide a method and a device for supplying fuel to internal combustion engine which is capable of improving combustion of an internal combustion engine without using a very high fuel injection pressure.

This object is achieved by a method for supplying fuel to an internal combustion engine wherein the liquid fuel used is a multi-component fuel having a mixture of components, comprising, a step of adjusting a temperature and a pressure of liquid fuel so that all the components of the liquid fuel reach a supercritical state and the liquid fuel becomes fuel in the supercritical state and a step of supplying the fuel in the supercritical state to a combustion chamber of the internal combustion engine wherein the pressure and the temperature in the combustion chamber are selected so that the state of the fuel supplied into the combustion chamber changes from the supercritical phase to a liquid phase in the combustion chamber.

In this aspect of the present invention, the liquid fuel is in a supercritical state, and this supercritical state fuel is supplied to the combustion chamber. In the supercritical state, both the temperature and the pressure of the liquid fuel are higher than the critical values. In this condition, the liquid fuel becomes a gaseous fluid which has a very high density and has physical properties very near to those of a liquid. However, since the pressure and the temperature in the combustion chamber are selected so that the fuel supplied to the combustion chamber changes from the supercritical phase to a liquid phase, when the liquid fuel in the supercritical state is injected from the fuel injection valve into the combustion chamber, it forms a fine mist of fuel and disperses into the combustion chamber. Further, since the fuel mist is generated by a change of phases, i.e., from the supercritical gas phase to the liquid phase, the size of the liquid fuel particles of the mist becomes extremely small.

As explained later, the critical pressure of liquid fuel is relatively low (for example, in case of diesel fuel, the critical pressure is generally much lower than 10 MPa). Therefore, by injecting fuel in the supercritical state, it is possible to improve the combustion of an engine by forming a very fine mist of fuel in the combustion chamber without raising the fuel injection pressure to a very high level.

According to another aspect of the present invention, there is provided a method for supplying fuel to an internal combustion engine for a vehicle comprising a step for reforming liquid fuel by adjusting the temperature and pressure of the fuel on the vehicle in such a manner that at least some of the components of the fuel are in a supercritical state and a step for supplying the fuel, after it is reformed, to a combustion chamber of an internal combustion engine.

In this aspect of the invention, liquid fuel is reformed on the vehicle by bringing the fuel into the supercritical state. Liquid fuel, such as diesel fuel, contains a relatively large amount of heavy components such as normal paraffin components and aromatic hydrocarbons having large molecular weights. These components, when burned in the combustion chamber, form particulate matter (carbon particles) in the exhaust gas. It is found that these heavy normal paraffin components are cracked at a relatively low temperature and produce light components such as normal paraffin having low molecular weight when the fuel is kept in the supercritical state. Therefore, in this aspect of the invention, liquid fuel containing a large amount of heavy components is reformed on the vehicle, and the reformed fuel which contains a large amount of light components is supplied to the combustion chamber of the engine. Therefore, the combustion of the engine is improved.

The reformed fuel may be supplied to the engine in the supercritical state. In this case, the combustion of the engine is further improved due to the improvement in the atomization of the fuel and the increase in the amount of the light components in the supplied fuel.

Further, in the above aspects of the invention, when diesel fuel is used, an oxygen-containing substance may be added to the fuel before it reaches the supercritical state. In this specification, the term "oxygen-containing substance" means a substance such as water or methanol which contains oxygen or a hydroxyl group. When the fuel containing the oxygen-containing substance is burned, production of aromatic hydrocarbons during the combustion is suppressed and, thereby, the combustion is improved. Further, when the fuel containing an oxygen-containing substance is reformed in the supercritical state, production of aromatic hydrocarbons is suppressed during the cracking of heavy normal paraffin. Therefore, the combustion of the engine is improved.

In another aspect of the present invention, there is provided a device for supplying fuel to an internal combustion engine wherein the liquid fuel used is a multi-component fuel having a mixture of components, comprising a fuel tank for storing the liquid fuel, a fuel injection valve for injecting fuel into a combustion chamber of an internal combustion engine wherein the pressure and the temperature in the combustion chamber are selected so that the fuel supplied to the combustion chamber becomes a liquid phase, a fuel supply path between the fuel tank and the fuel injection valve, supercritical state generating means disposed in the fuel supply path between the fuel tank and the fuel injection valve for adjusting a temperature and a pressure of the fuel so that at least some of the components of the liquid fuel reach a supercritical state before the fuel is injected into the combustion chamber.

According to this aspect of the invention, liquid fuel reaches a supercritical state due to the supercritical state generating means before it is injected into the combustion chamber. Therefore, the fuel in the supercritical state, or the fuel reformed by keeping it in a supercritical state is supplied to the combustion chamber of the engine. The supercritical state generating means may include a pressurizing means such as a pump for raising the pressure of the fuel to higher than the critical pressure and heating means such as a heater for raising the temperature of fuel to above the critical temperature.

According to another aspect of the present invention, there is provided a method for supplying diesel fuel to an internal combustion engine comprising a step for reforming diesel fuel by keeping the fuel in the conditions where the temperature is higher than 400° C. and the pressure is higher than 1.5 MPa and a step for supplying the fuel, after it is reformed, to the engine.

In this aspect of the invention, diesel fuel (gas oil) is reformed by keeping it in the conditions where the temperature is higher than 400° C. and the pressure is higher than 1.5 MPa. It was found that, in these conditions, the heavy normal paraffin components in diesel fuel are cracked and produce lighter normal paraffin components. Further, the specific gravity and kinematic viscosity of the diesel fuel are largely lowered without changing the cetane number of the fuel by reforming the diesel fuel in these conditions. Therefore, by adding more than 1 percent weight of the reformed fuel to normal diesel fuel, the atomization of the fuel when injected into the combustion chamber is improved.

According to another aspect of the present invention, there is provided a method for supplying diesel fuel to an internal combustion engine comprising a step for reforming diesel fuel by keeping the fuel in the conditions where the temperature is between 400° C. and 550° C. and the pressure is higher than 1.5 MPa and a step for supplying the fuel, after it is reformed, to the engine.

In this aspect of the invention, diesel fuel (gas oil) is reformed by keeping it in the conditions where the temperature is between 400° C. and 550° C. and the pressure is higher than 1.5 MPa. It was found that, in these conditions, heavy normal paraffin components in the diesel fuel are cracked and produce lighter normal paraffin components without producing heavy alkylbenzene components. Also in this case, more than 1 percent by weight of the reformed fuel may be added to a normal diesel fuel.

BRIEF DESCRIPTION OF THE DRAWINGS

The present invention will be better understood from the description as set forth hereinafter, with reference to the accompanying drawings in which:

FIGS. 5 through 9 are graphs and tables illustrating the result of the reforming of diesel fuel in the supercritical state.

DESCRIPTION OF THE PREFERRED EMBODIMENT

Figure 1:
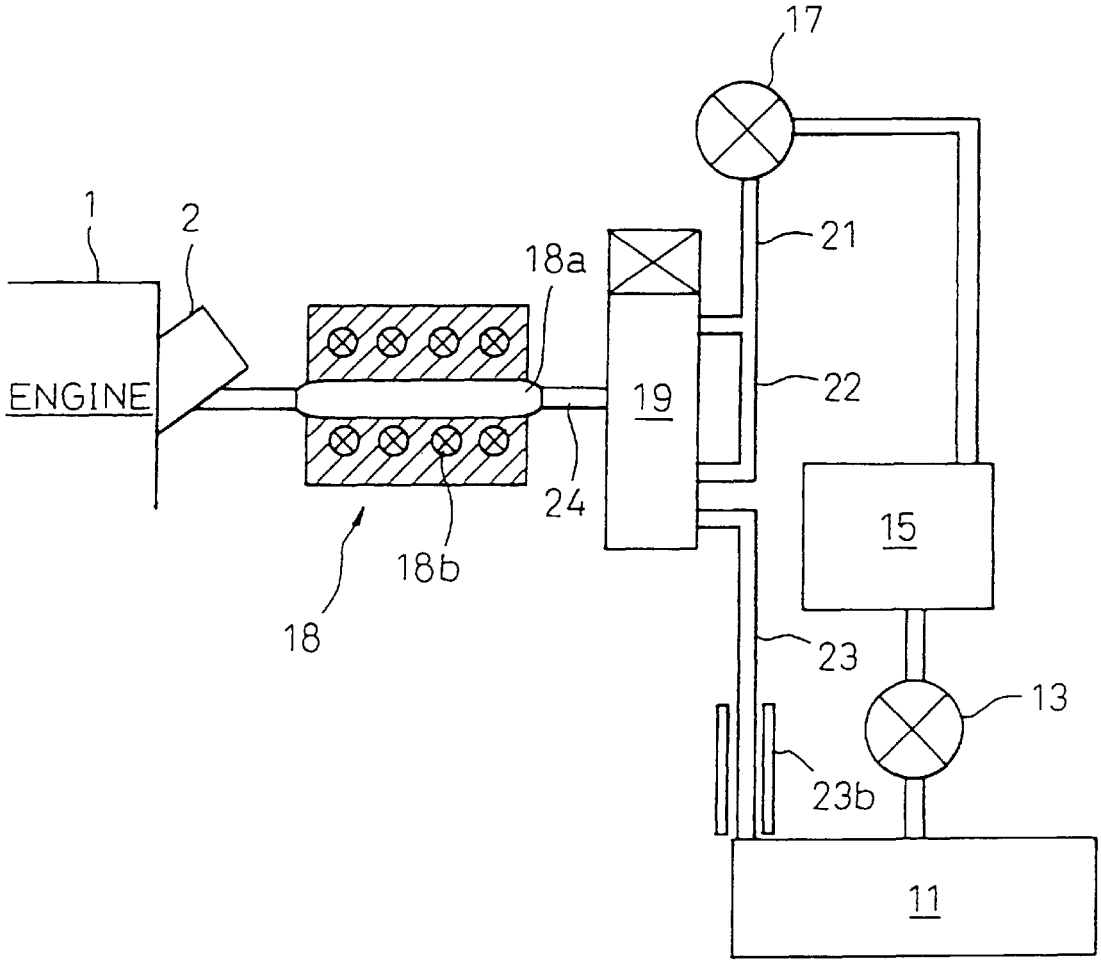
FIG. 1 schematically illustrates the general configuration of an embodiment of the present invention.

Hereinafter, embodiments of the present invention will be explained in detail with reference to the accompanying drawings. However, before explaining the embodiments, the supercritical state of liquid fuel will be explained.

The supercritical state is a state achieved by heating a substance above the critical temperature under a pressure higher than the critical pressure. When a liquid substance is pressurized and heated to the supercritical state, the phase of the substance changes from liquid to gas. However, gas in the supercritical state has a very high density and, therefore, it shows physical characteristics very similar to liquid. Namely, when liquid is in the supercritical state, it becomes a supercritical fluid having physical characteristics between those of liquid and gas. Since the supercritical fluid has a very high density, it has a large energy and shows a unique behavior.

For example, when the supercritical fuel fluid is injected from the fuel injection valve into the combustion chamber which has a pressure and temperature lower than that of the supercritical state, a mist of fuel having particle sizes much smaller than those formed by the high pressure fuel injection is uniformly formed in the combustion chamber. When the supercritical fuel fluid is injected from the fuel injection valve, the temperature and/or pressure of the fluid becomes lower than the critical values. In this case, if the pressure and the temperature in the combustion chamber are selected so that the supercritical fuel supplied to the combustion chamber returns to a liquid state, the fuel injected into the combustion chamber forms a mist of fuel having very small particle size. Since the particles of fuel in the mist are formed by a change of phase (i.e., condensing), the size of the particles are very small compared to the size of the particles mechanically formed by high pressure fuel injection. In addition to that, since the fuel injected from the injection valve instantaneously forms liquid particles, the particles disperse throughout the entire combustion chamber due to their large momentums, and a very fine mist of fuel is uniformly formed in the entire combustion chamber.

Further, the critical pressure of diesel fuel is relatively low (for example, generally lower than 10 MPa). This means that, by injecting fuel in the supercritical state, a uniform fine mist of fuel having a much smaller particle size compared to those in the high pressure fuel injection is obtained with much lower fuel pressure.

Further, each of the fuel particles formed by the injection of supercritical fuel fluid have a high energy level due to latent heat released by the condensation and, therefore, readily react with oxygen. In addition to that, since the fine mist of fuel is uniformly formed in the entire combustion chamber by the injection of supercritical fuel fluid, sufficient oxygen is supplied to each fuel particle which is, as explained above, highly reactive. Therefore, the fuel in the combustion chamber is readily ignited and is burned completely, i.e., the combustion of the engine is largely improved and, thereby, both the exhaust gas emission and fuel consumption of the engine are reduced by the improvement of the combustion.

Figure 4:
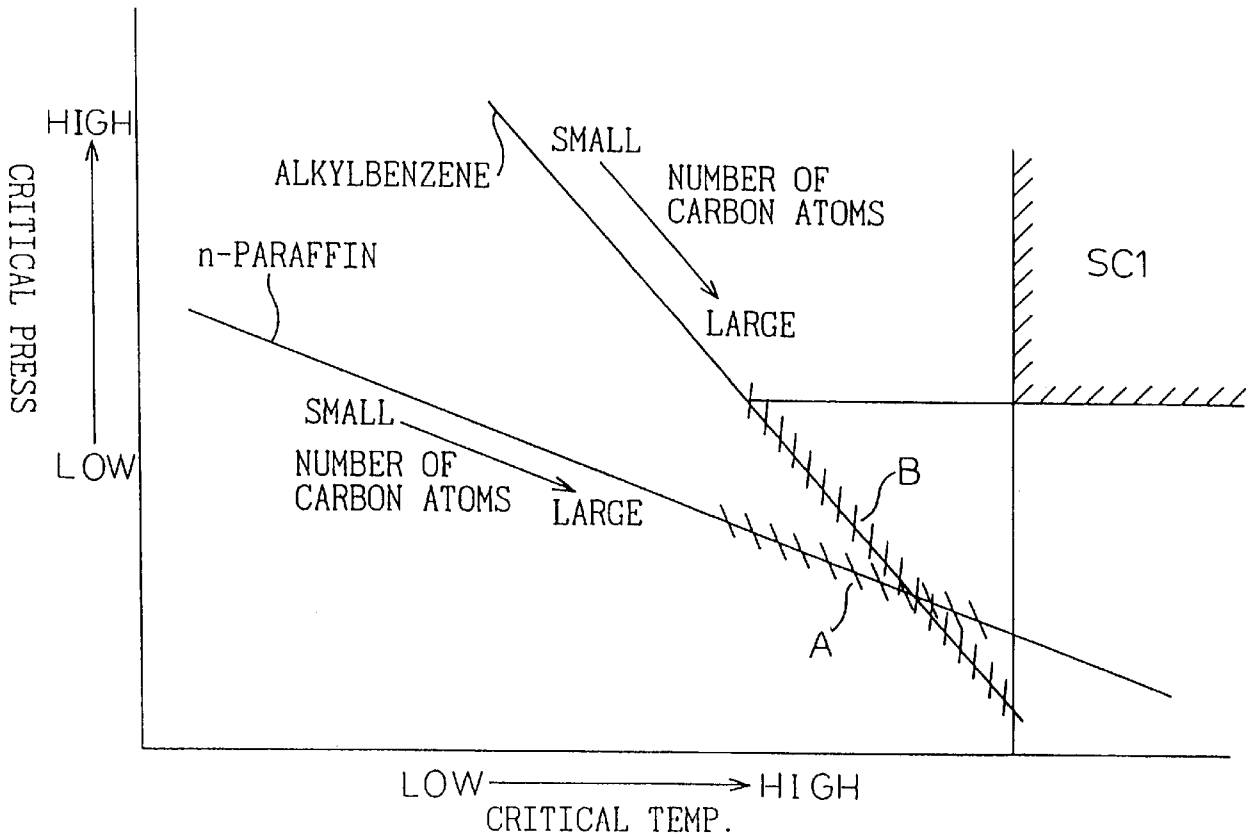
FIG. 4 is a graph showing the critical pressure and the critical temperature of the components contained in diesel fuel.

FIG. 4 is a graph illustrating the pressure and temperature conditions required to make diesel fuel reach the supercritical state. Generally speaking, diesel fuel is a mixture of normal paraffin (n-paraffin) having 11 to 20 carbon atoms and aromatic hydrocarbons (alkylbenzene) having 10 to 22 carbon atoms. Since the critical pressure and the critical temperature depend on the substance, each component of diesel fuel has different critical pressure and temperature.

FIG. 4 illustrates the change in the critical pressure and temperature of n-paraffin and alkylbenzene in accordance with the difference in the number of carbon atoms. The vertical axis and the horizontal axis in FIG. 4 represent the critical pressure and the critical temperature of the respective components. As shown in FIG. 4, in general, the critical pressure becomes lower as the number of carbon atoms becomes larger, and the critical temperature becomes higher as the number of carbon atoms becomes larger. Further, when the n-paraffin and the alkylbenzene having same number of carbon atoms are compared, both the critical pressure and the critical temperature of the n-paraffin are generally lower than the same of the alkylbenzene.

The hatched portions A and B in FIG. 4 indicate the range of the numbers of carbon atoms of the n-paraffin components and the alkylbenzene components usually composing diesel fuel. As can be seen from FIG. 4, it is required that both the pressure and the temperature of the diesel fuel must be in the region SC1 in FIG. 4 in order to make all the components in diesel fuel reach the supercritical state. The region SC1 represents a pressure more than 2.5 MPa and a temperature more than 450° C. The pressure and the temperature in the combustion chamber when diesel fuel is injected (i.e., near the top dead center of the compression stroke) are about 2 MPa and less than 250° C. In this condition, most of the components of diesel fuel are in the liquid phase. Therefore, when the diesel fuel in the supercritical state (i.e., pressure more than 2.5 MPa and temperature more than 450° C.) is injected into the cylinder, injected fuel changes from a supercritical (gaseous) phase to a liquid phase and forms liquid particles (i.e. a fuel mist). Since the liquid fuel particles are formed by a change of phase, the size of the particles is very small. In diesel engines, it is very important that the fuel is injected in the liquid state so that the fuel particles disperse into the combustion chamber before they burn. Thus, by injecting diesel fuel in the supercritical state into the combustion chamber, a very fine mist is uniformly formed in the entire combustion chamber with a low fuel injection pressure.

However, in the actual operation, it is found that the improvement of the combustion of the engine can be achieved even when only some of the components in diesel fuel reach a supercritical state. Therefore, even in a pressure/temperature condition in which only some of the n-paraffin components and the alkylbenzene components are in the supercritical state, for example, when the pressure is more than 1 MPa and the temperature is more than 300° C., an improvement in the combustion of the engine can be achieved. As explained before, the critical pressure becomes lower as the number of carbon atoms in the components increase while the critical temperature becomes higher as the number of carbon atoms in the components increase.

Therefore, if only some of the components of diesel fuel should reach the supercritical state, the pressure can be lowered when the temperature is maintained at high level.

As explained above, combustion of the engine is improved, with a much lower fuel injection pressure compared to that of the high pressure fuel injection system, by injecting diesel fuel into combustion chambers in the supercritical state. Therefore, by injecting diesel fuel in the supercritical state, the pressure rating of the fuel injection pump can be largely lowered and, thereby, the cost of fuel injection pump can be lowered and the reliability thereof improved.

Next, reforming of fuel by a supercritical treatment is explained.

It has been found that heavy components in liquid fuel are converted to lighter components, i.e., reforming of fuel is performed, by keeping liquid fuel in the supercritical state for a certain time (i.e., a supercritical treatment).

Figure 5:
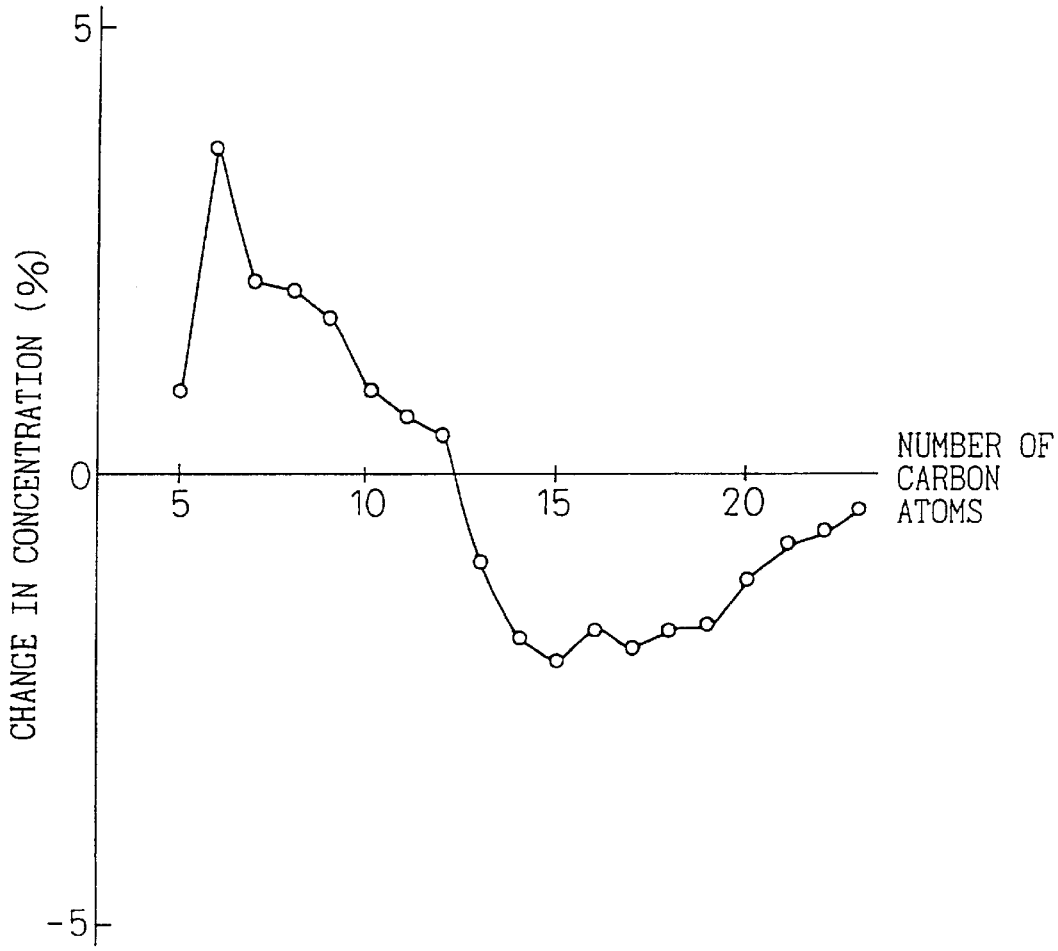

FIG. 5 shows the result of reforming of diesel fuel by the supercritical treatment. In FIG. 5, the vertical axis represents the change in the concentrations of the n-paraffin components in diesel fuel caused by the supercritical treatment, and the horizontal axis represents the number of carbon atoms in the respective n-paraffin components. FIG. 5 shows the case where diesel fuel is held at the temperature between 400 and 500° C. and the pressure between 4 and 5 MPa for about 20 minutes. As can be seen from FIG. 5, the concentrations of heavy n-paraffin components (number of carbon atoms is 13 or more) decrease and, at the same time, the concentrations of light n-paraffin components (number of carbon atoms is 12 or less) increase due to the supercritical treatment. This means that a part of the heavy components in diesel fuel are converted to the lighter components, i.e., diesel fuel is reformed by the supercritical treatment. Further, it is found that the increase in the light n-paraffin components becomes larger as the pressure and temperature in the supercritical treatment become higher and the time of the supercritical treatment becomes longer.

According to experiment, it was found that a pressure more than 1.5 MPa is preferable to reform the heavy components in diesel fuel. FIG. 7 shows the results of experiments in which diesel fuel is treated at various temperatures and times under a pressure 1.5 MPa. In FIG. 7, the letter C represents the case where no change of the concentrations of the components of the diesel fuel occurred during the treatment, the letter B represents the case where the amount of heavy n-paraffin components is slightly decreased by the treatment and the letter A represents the case where the amount of heavy n-paraffin components is decreased by the treatment. As can be seen from FIG. 7, when the pressure is kept at 1.5 MPa, diesel fuel is reformed (i.e., the heavy components in the diesel fuel decrease) when the temperature is more than 400° C. Further, as can be seen from FIG. 7, as the temperature becomes higher, the time required for reducing the heavy components becomes shorter. For example, in FIG. 7, when the temperature is 400° C., a 120 minutes treatment time is required to reduce the heavy components. However, it takes less than 1 minute when the temperature is higher than 475° C.

As explained above, in order to reduce the heavy components in the diesel fuel, it is preferable to raise the temperature and pressure as high as possible. However considering the reliability of the elements in the reforming device and the seal problems, it is preferable to use a temperature lower than 600° C. and a pressure lower than 30 MPa.

Figure 6:
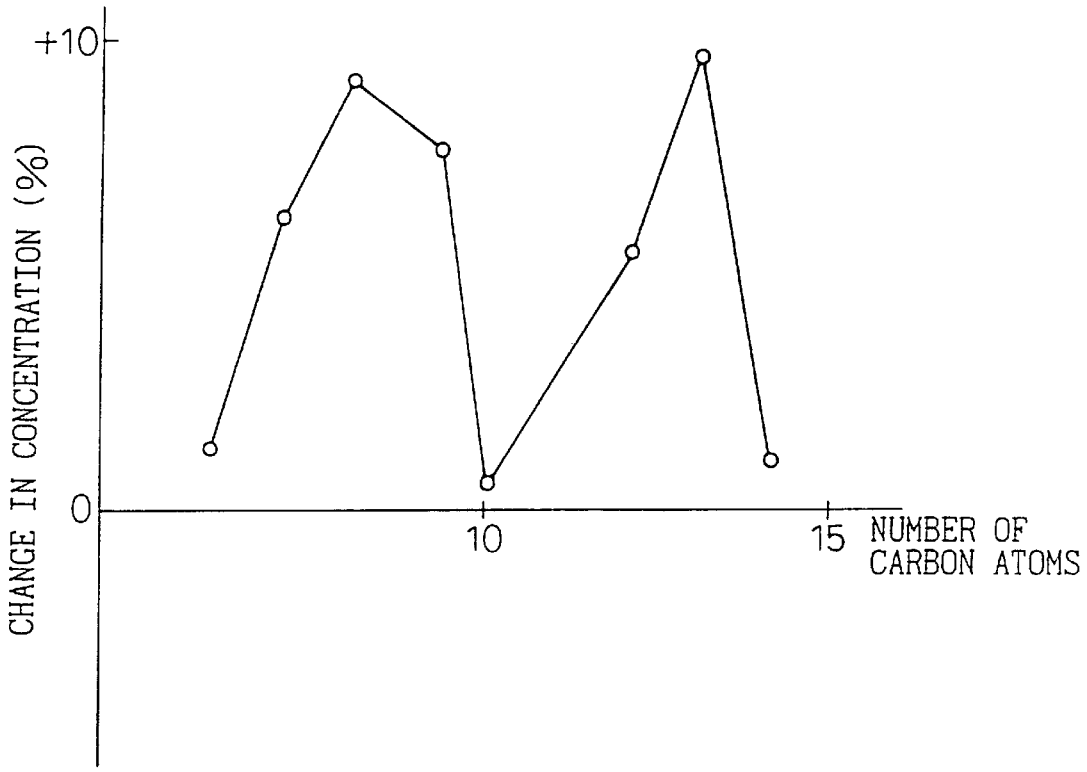

Further, it was also found that light alkylbenzene components are produced by the decomposition of heavy n-paraffin components and the concentrations of alkylbenzene components increase when the temperature of the supercritical treatment is high. FIG. 6 shows the change in the concentrations of alkylbenzene components in the same diesel fuel as FIG. 5 due to the supercritical treatment where the diesel fuel is kept at 600° C. and 5 MPa for about 20 minutes. As can be seen from FIG. 6, when the temperature in the supercritical treatment is high, light alkylbenzene components (the number of carbon atoms is 12 or less) increase due to the conversion of heavy n-paraffin components to light alkylbenzene components.

Generally, particulate matter in the exhaust gas of the engine increases as the alkylbenzene components or heavy n-paraffin components in diesel fuel increase. Especially, the alkylbenzene components having the number of carbon atoms more than 12 increases the particulate matter in the exhaust gas. Therefore, it is not preferable that the heavy alkylbenzene components in diesel fuel increase due to the supercritical reforming treatment.

FIG. 8 shows the results of experiments in which diesel fuel is treated at various temperature and time under a pressure of 5 MPa. In FIG. 8, the letter C represents the case where the concentrations of the heavy alkylbenzene components of the diesel fuel are increased by the treatment, the letter B represents the case where the heavy alkylbenzene components are slightly increased by the treatment and the letter A represents the case where the heavy alkylbenzene components are not increased by the treatment. As can be seen from FIG. 8, the heavy alkylbenzene components increases when the temperature is higher than 550° C. even when the treatment time is 1 minute. However, as can be seen from FIG. 8, as the temperature becomes lower, the treatment time which does not increase the heavy alkylbenzene components becomes longer.

Therefore, when the pressure is higher than 1.5 MPa, and the temperature between 400° C. and 550° C., the conditions where the heavy n-paraffin components reform and, at the same time, the heavy alkylbenzene components do not increase can be found.

Further, in order to suppress the production of alkylbenzene during the supercritical reforming treatment, it is effective to add an oxygen-containing substance such as water and methanol to the diesel fuel to be treated. By applying the supercritical reforming treatment to diesel fuel after adding water or methanol at several percent to about twenty percent by weight, the conversion of decomposed heavy n-paraffin components to alkylbenzene components is suppressed. Further, it is known that small amounts of alkylbenzene components are produced by the combustion of n-paraffin components in diesel fuel. However, by adding the oxygen-containing substance to diesel fuel, the production of alkylbenzene components during the combustion of diesel fuel can be suppressed and, thus, the amount of the particulate matter in the exhaust gas can be reduced.

FIG. 9 shows changes in the physical properties of diesel fuel caused by the supercritical treatment. FIG. 9 shows the physical properties of a normal diesel fuel (a gas oil which complies with JIS JTD-5) and the properties of the fuel obtained by reforming the same diesel fuel in the condition where the pressure is 5 MPa and the temperature is between 400 and 550° C. As can be seen from FIG. 9, the kinematic viscosity and flash point are lowered by the supercritical treatment while maintaining the same cetane number. This means that, when the reformed fuel is injected into the combustion chamber, it forms a fine mist (due to the lower kinematic viscosity) which readily ignites (due to the lower flash point) in the combustion chamber. Further, the fact that the reformed fuel has a lower initial boiling point and a lower flash point means that the reformed fuel has a higher volatility than normal diesel fuel while maintaining the same cetane number. Therefore, the reformed fuel can be used as an additive for the normal diesel fuel to promote initial combustion in the combustion chamber. When used as an additive for normal diesel fuel to promote the initial combustion, the concentration of the reformed fuel in the mixture should be more than 1 percent by weight, preferably more than 5 percent by weight.

Next, an embodiment of a fuel injection device for the injection of liquid fuel in the supercritical state into the combustion chamber of the engine is explained. FIG. 1 schematically illustrates the general configuration of a fuel injection device according to the present invention.

In FIG. 1, reference numeral 1 designates a diesel engine, 2 designates a fuel injection valve which injects diesel fuel in the supercritical state into the respective combustion chambers of the engine 1. 11 in FIG. 1 is a fuel storage tank for storing diesel fuel of the engine and, 13 is a feed pump for supplying diesel fuel in the storage tank 11 to a injection fuel tank 15.

Numeral 17 in FIG. 1 is a critical pressure pump which feeds the diesel fuel from the tank 15 to the supercritical fuel injection pump 19 at a pressure higher than the critical pressure. Numeral 18 is a supercritical state generating device which includes a heating device such as an electric heater 18*b* for heating the diesel fuel supplied from the supercritical fuel injection pump 19 to the fuel injection valve 2 so that the temperature of the diesel fuel becomes higher than the critical temperature.

The diesel fuel in the injection fuel tank is pressurized by the critical pressure pump to, for example, more than 2.5 MPa and flows into a heating chamber 18*a* in the supercritical state generating device 18 through a fuel passage 19*h* disposed in the body 19*a* of the supercritical fuel injection pump 19, as explained later. Then, the fuel in the heating chamber 18*a* is heated by the heater 18*b* to a temperature higher than the critical temperature (for example, 450° C.) and reaches the supercritical state. When a fuel injection timing occurs, the diesel fuel in the heating chamber 18*a* is further pressurized by a plunger 19*b* of the supercritical fuel injection pump 19. When the pressure in the heating chamber 18*a* becomes higher than an opening pressure of the fuel injection valve 2, fuel in the supercritical state is injected from the fuel injection valve 2 and forms an extremely fine uniform fuel mist in the combustion chamber of the engine 1.

Figure 2:
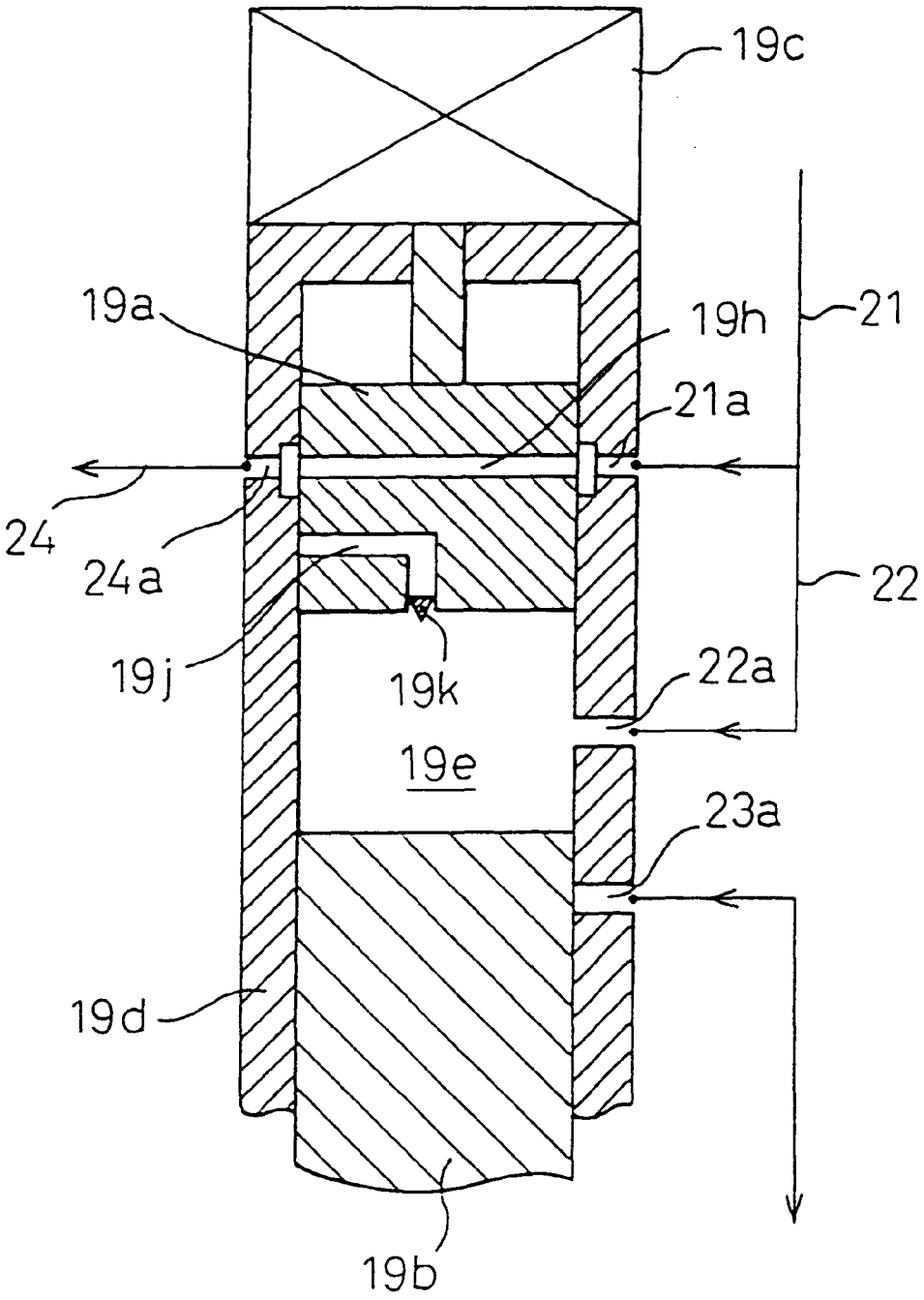
FIG. 2 schematically illustrates the general configuration of an embodiment of the supercritical fuel injection pump.

FIG. 2 shows a general construction of the supercritical fuel injection pump 19 in FIG. 1.

In FIG. 19, 19*d* is a cylinder of the supercritical fuel injection pump 19, 19*c* is a solenoid actuator which is mounted on the cylinder 19*d*. 19*a* is a spool disposed in the cylinder 19*d*. Driven by the solenoid actuator 19*c*, the spool 19*a* slides within the cylinder 19*d*. 19*b* is a plunger which is driven by a camshaft (not shown) of the engine 1 and reciprocates within the cylinder. 19*e* in FIG. 1 is a pressure chamber defined in the cylinder 19*d* by the spool 19*a* and the plunger 19*b*. The stroke of the plunger is adjusted by a governor (not shown) in accordance with the load of the engine 1. During the downward motion of the plunger 19*b*, the spool 19*a* is held at a downward position as shown in FIG. 2 by the solenoid 19*c*. This causes the fuel from the critical pressure pump 17 to flow directly into the heating chamber 18*a* of the supercritical state generating device 18 through the pipe 21, the port 21*a* of the cylinder 19*d*, the fuel passage 19*h* of the spool 19*a*, the port 24*a* and the pipe 24. Fuel is also fed from the critical pressure pump 17 to the pressure chamber 19*e* through the pipes 22 and 22*a*. After the plunger 19*b* reaches a position of the port 23*a* during its downward stroke, excess fuel is returned to the storage tank 11 through the port 23*a* and the return pipe 23. The return pipe 23 is provided with a cooling water jacket 23*b* for cooling the fuel flowing through the pipe 23.

When the upward stroke of the plunger 19*b* starts, the ports 23*a* and 22*a* are closed by the plunger 19*b* and the pressure of the fuel in the pressure chamber 19*e* increases. In this condition, when a fuel injection timing occurs, the spool 19*a* is moved to an upward position by the solenoid 19*c*. At the upward position of the spool 19*a*, the fuel passage 19*h* is closed, and another fuel passage 19*j* is connected to the port 24*a*. Therefore, the fuel in the pressure chamber 19*e* which is pressurized by the upward motion of the plunger 19*b* flows into the heating chamber 18*a* of the supercritical state generating device 18. This causes the pressure in the heating chamber 18*a* to increase further. The passage 19*j* is provided with check valve 19*k* for preventing the backflow of the pressurized fuel from the heating chamber 18*a* to the pressure chamber 19*e*.

When the pressure of the fuel in the heating chamber becomes higher than the valve opening pressure of the fuel injection valve 2 during the upward motion of the plunger 19*b*, the supercritical state fuel in the chamber 18*a* is injected from the fuel injection valve 2 into the combustion chamber of the engine 1. After the required amount of the fuel is injected, the plunger 19*b* starts the downward stroke. This lowers the pressure of the fuel in the heating chamber 18*a*, and when the pressure in the chamber 18*a* becomes lower than the opening pressure of the fuel injection valve 2, the fuel injection stops. In this condition, since the check valve 19*k* closes, the pressure in the heating chamber 18*a* is kept higher than the critical pressure and, thereby the fuel in the heating chamber is kept in the supercritical state. Then, the spool 19*a* is moved to the downward position as shown in FIG. 2, and next fuel injection cycle starts.

The time the fuel resides in the heating chamber 18*a* can be arbitrary set by selecting the volume of the heating chamber 18*a*. Therefore, the residence time can be set long enough to assure that the fuel is heated to the temperature higher than the critical temperature by the heater 18*b*. As explained above, a liquid fuel in the supercritical state can be injected into the combustion chamber of the engine by the fuel injection system in FIGS. 1 and 2.

It is preferable to set the opening pressure of the fuel injection valve 2 and the temperature in the heating chamber 18*a* higher than the pressure and the temperature which can make all the components in the fuel reach the supercritical state (for example, a temperature higher than 500° C. and a pressure higher than 3 MPa). However, as explained before, even if the temperature and pressure conditions are set so that only some of the components in the fuel reach the supercritical state, it is possible to form a very fine mist in the combustion chamber. Further, the oxygen-containing substance such as water or methanol may be added to the fuel in the tank 11 in order to suppress the formation of alkylbenzene components by the combustion of the fuel.

Next, an example of the device for reforming liquid fuel by applying the supercritical treatment is explained with reference to FIG. 3.

Figure 3:
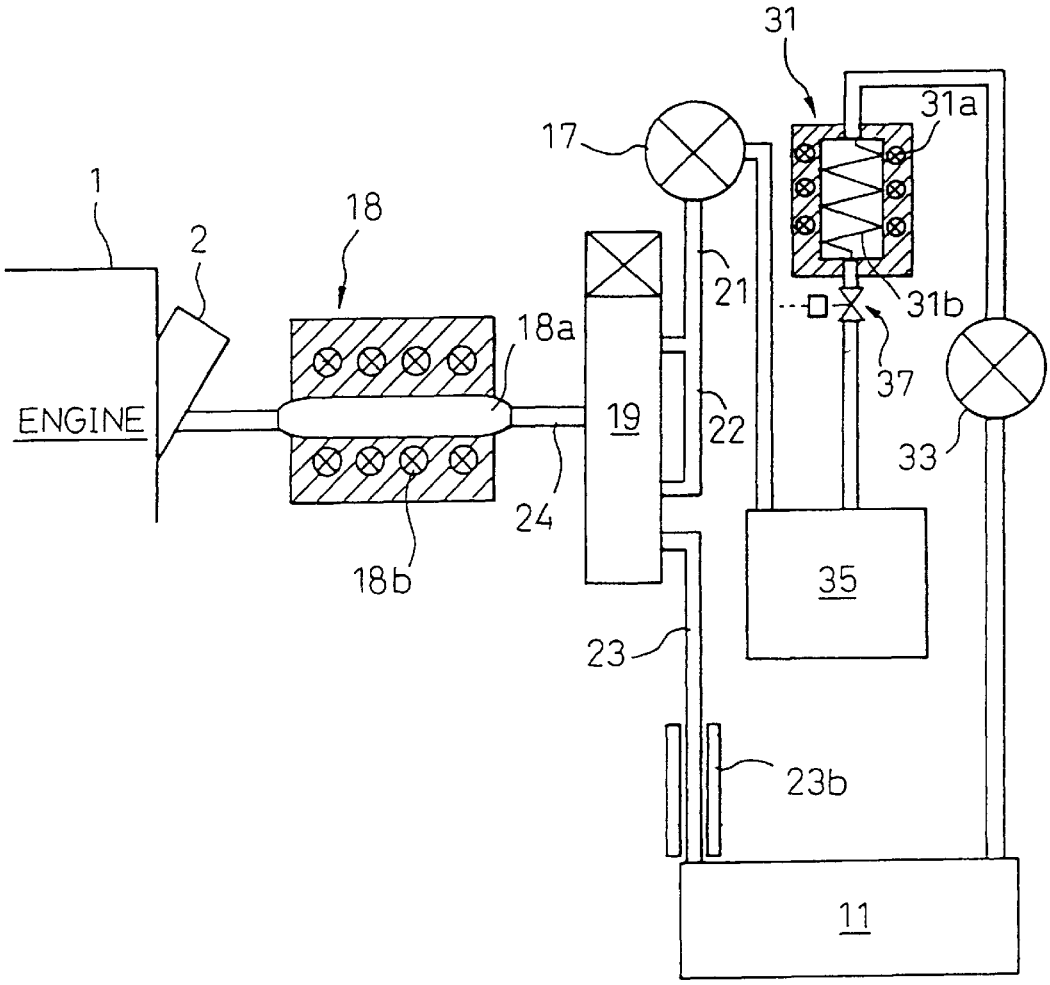
FIG. 3 illustrates the general configuration of another embodiment of the present invention.

FIG. 3 shows a general configuration of the device which reforms the fuel in the storage tank 11 by the supercritical treatment. In FIG. 3 reference numerals the same as those in FIGS. 1 and 2 designate the same elements.

In the embodiment in FIG. 3, a supercritical reformer 31 and a second critical pressure pump 33 which feeds the fuel in the tank 11 to the supercritical reformer 31 are provided. Further, a reformed fuel tank 35 which stores the reformed fuel instead of the fuel injection tank 15 in FIG. 1 is provided.

In this embodiment, the second critical pressure pump 33 feeds the diesel fuel to the supercritical reformer 31 at a pressure higher than 1.5 MPa. The supercritical reformer 31 is provided with a heater 31*a* and a heating passage heating passage 31*b*. The fuel is heated by the heater 31*a* to a temperature higher than the critical temperature when it flows through the heating passage 31*b*, and reaches the supercritical state. The flow velocity of the fuel in the heating passage 31*b*, i.e., the time the fuel resides in the passage 31*b* is controlled by a flow control valve 37. In this embodiment, the capacity of the heater 31*a* and the flow of the fuel in the supercritical reformer 31 is selected so that the fuel is held within the heating passage 31*b* for about 1 to 20 minutes at a temperature between 400° C. and 550° C. By this arrangement, the fuel is reformed in the supercritical state when it flows through the heating passage 31*b*, and the reformed fuel flows into the reformed fuel tank 35.

Further, the reformed fuel in the reformed fuel tank 35 is made the supercritical state again by the critical pressure pump 17, supercritical fuel injection pump 19 and supercritical state generating device 18 before it is injected from fuel injection valve 2 into the combustion chamber of the engine. The constructions and the functions of these devices are the same as those explained in the embodiment in FIG. 1, and a detailed explanation is not given here.

According to the present embodiment, all the devices required for reforming the fuel are disposed on the fuel path between the fuel storage tank 11 and the fuel injection valve 2. Therefore, when the system in FIG. 2 is applied to an engine for a vehicle, normal liquid fuel supplied to the vehicle can be reformed by equipment on the vehicle. This feature is especially advantageous because a normal fuel can be supplied to the vehicle and a facility for supplying the special (reformed) fuel to the vehicle is not required.

The reformed fuel is injected from the fuel injection valve in the supercritical state in this embodiment. However, the combustion of the engine is largely improved even if the reformed fuel is injected in a normal state (i.e., at a lower fuel injection pressure). Further, though the fuel flows through the supercritical reformer 31, and is reformed continuously in the above embodiment, a certain amount of the fuel may be reformed at a time. In this case, a shutoff valve which may be opened and closed by a timer is provided instead of flow control valve 37 to hold a certain amount of the fuel within the supercritical reformer 31 for a predetermined time. After the fuel in the supercritical reformer 31 is reformed, the shutoff valve is opened to drain the reformed fuel in the reformer 31 to the reformed fuel tank 35. Further, the oxygen-containing substance such as water or ethanol may be added to the fuel in the storage tank 11 also in this embodiment in order to suppress the production of alkylbenzene components during the reforming and combustion of the reformed fuel.

As explained above, according to the present invention, the combustion in the combustion chamber of the engine is improved and, thereby, the exhaust gas emission and the fuel consumption of the engine are reduced at the same time by injecting and/or reforming liquid fuel in the supercritical state without using a very high fuel injection pressure.

What is claimed is:

1. A method for supplying fuel to an internal combustion engine wherein the liquid fuel used is a multi-component fuel having a mixture of components, comprising:

a step of adjusting a temperature and a pressure of liquid fuel so that all the components of the liquid fuel reach a supercritical state; and a step for supplying the fuel in the supercritical state to a combustion chamber of the internal combustion engine wherein the pressure and the temperature in the combustion chamber are selected so that the state of the fuel supplied into the combustion chamber changes from the supercritical phase to a liquid phase in the combustion chamber.

2. A method according to claim 1, wherein said internal combustion engine is a diesel engine, and said liquid fuel is diesel fuel.

3. A method according to claim 2, further comprising a step of adding an oxygen-containing substance to the fuel before it reaches the supercritical state.

4. A device for supplying fuel to an internal combustion engine wherein the liquid fuel used is a multi-component fuel having a mixture of components, comprising:

a fuel tank for storing the liquid fuel;

a fuel injection valve for injecting fuel into a combustion chamber of an internal combustion engine wherein the pressure and the temperature in the combustion chamber are selected so that the fuel supplied to the combustion chamber becomes a liquid phase;

a fuel supply path between the fuel tank and the fuel injection valve;

supercritical state generating means disposed in the fuel supply path between the fuel tank and the fuel injection valve for adjusting a temperature and a pressure of the fuel so that at least some of the components of the fuel reach a supercritical state before the fuel is injected into the combustion chamber.

5. A device according to claim 4, wherein said supercritical state generating means includes a pressurizing means for raising the pressure of the fuel to a predetermined pressure and a heating means for raising the temperature of the fuel to a predetermined temperature.

* * * * *